US009412244B2

(12) United States Patent
Taylor et al.

(10) Patent No.: US 9,412,244 B2
(45) Date of Patent: Aug. 9, 2016

(54) SMART SENSOR LINE ALARM SYSTEM

(71) Applicant: InVue Security Products Inc., Charlotte, NC (US)

(72) Inventors: Gary A. Taylor, Fort Mill, SC (US); David N. Berglund, Charlotte, NC (US); Jeffrey A. Grant, Charlotte, NC (US); Christopher J. Fawcett, Charlotte, NC (US); Larry T. McKinney, Huntersville, NC (US)

(73) Assignee: InVue Security Products Inc., Charlotte, NC (US)

( * ) Notice: Subject to any disclaimer, the term of this patent is extended or adjusted under 35 U.S.C. 154(b) by 273 days.

(21) Appl. No.: 14/049,628

(22) Filed: Oct. 9, 2013

(65) Prior Publication Data

US 2014/0111337 A1 Apr. 24, 2014

Related U.S. Application Data

(60) Provisional application No. 61/715,489, filed on Oct. 18, 2012.

(51) Int. Cl.
*G08B 13/14* (2006.01)
*E05B 73/00* (2006.01)

(52) U.S. Cl.
CPC ..... *G08B 13/1445* (2013.01); *G08B 13/14* (2013.01); *G08B 13/1409* (2013.01); *G08B 13/1454* (2013.01); *E05B 73/0017* (2013.01); *G08B 13/1472* (2013.01)

(58) Field of Classification Search
None
See application file for complete search history.

(56) References Cited

U.S. PATENT DOCUMENTS

| | | | | |
|---|---|---|---|---|
| 5,726,627 | A | 3/1998 | Kane et al. | |
| 6,278,365 | B1 | 8/2001 | Kane et al. | |
| 7,015,596 | B2 | 3/2006 | Pail | |
| 7,209,038 | B1 * | 4/2007 | Deconinck | G08B 13/1409 340/541 |
| 7,626,500 | B2 | 12/2009 | Belden, Jr. et al. | |
| 2006/0071744 | A1 * | 4/2006 | Bogdon | H01H 71/46 355/172 |
| 2006/0071774 | A1 | 4/2006 | Brown et al. | |
| 2009/0243838 | A1 | 10/2009 | Jones | |
| 2012/0119909 | A1 * | 5/2012 | Rapp | A47F 7/024 340/568.2 |

(Continued)

FOREIGN PATENT DOCUMENTS

| | | | |
|---|---|---|---|
| DE | 19518752 | A1 | 11/1995 |
| JP | 2010-044593 | A | 2/2010 |
| KR | 10-2007-0088852 | A | 8/2007 |

OTHER PUBLICATIONS

Sung Chul Kang, International Search Report of corresponding International Patent Application No. PCT/US2013/064274, Jan. 21, 2014, pp. 1-10, Korean Intellectual Property Office, Daejeon Metropolitan City, Republic of Korea.

(Continued)

*Primary Examiner* — Mohamed Barakat
(74) *Attorney, Agent, or Firm* — InVue Security Products Inc.

(57) ABSTRACT

Embodiments of the present invention are directed to systems and methods for monitoring a status of a plurality of a merchandise display devices for displaying items of merchandise at respective display positions. For example, the method includes monitoring for a change in a preselected characteristic of a circuit defined by an electrical connection between the security devices and a plurality of nodes and between the nodes and an alarm unit. The method also includes determining whether an item of merchandise has been added to or removed from a respective display position based on a change in the preselected characteristic.

20 Claims, 2 Drawing Sheets

(56) References Cited

U.S. PATENT DOCUMENTS

| | | | | |
|---|---|---|---|---|
| 2012/0119910 | A1* | 5/2012 | Belden, Jr. | G08B 13/1445 340/568.8 |
| 2013/0009770 | A1* | 1/2013 | Yeager | G08B 29/04 340/506 |

OTHER PUBLICATIONS

Supplementary European Search Report for European Application #13846889 dated May 3, 2016, 10 pages, European Patent Office, Munich, Germany.

* cited by examiner

SMART SENSOR LINE ALARM SYSTEM

CROSS REFERENCE To RELATED APPLICATIONS

This non-provisional utility patent application claims the benefit of priority of U.S. Provisional Application No. 61/715,489, filed on Oct. 18, 2012, entitled Smart Sensor Line Alarm System, which is hereby incorporated by reference in its entirety.

FIELD OF THE INVENTION

Embodiments of the present invention relate generally to merchandise display systems and, in particular, to line alarm systems and methods for displaying merchandise in a plurality of display positions.

BACKGROUND OF THE INVENTION

U.S. Pat. No. 7,626,500 entitled Security Display With Central Control System assigned to InVue Security Products Inc. of Charlotte, N.C. describes a pseudo line alarm system in which each display module 15 and sensor 25 combination is electrically connected to a common power supply 5 and to a common central alarm unit 9. The common power supply 5 provides power from an external source (e.g. 120V AC outlet) to each display module 15 and sensor 25 at a predetermined operating power (i.e. voltage and/or current) via a power transformer 23 that may be provided by the OEM of the item of merchandise 3 being displayed at the Display Position. In this manner, each display module 15, sensor 25 and item of merchandise 3 at each Display Position is electrically connected in parallel to the power supply 5, and again in parallel to the central alarm module 9.

The central control system shown and described in the InVue U.S. Pat. No. 7,626,500 is particularly advantageous for displaying various items of merchandise having different operating power requirements using the power cables and transformers provided by the OEM of the item of merchandise. However, the capacity of the system is limited by the number of input jacks (ports) available on the central alarm module 9. It is possible to utilize one of the open ports to electrically connect another central alarm module 9 having additional ports to the system in a "daisy chain" manner. However, routing each of the cords 17 from the plurality of display modules 15 (with or without another central alarm module) to the ports of the central alarm module 9 introduces cord management issues, as well as potential cross talk and electrical interference concerns. Accordingly, management of the system, as well as the aesthetics of the merchandise display, can become problematic with only a few Display Positions installed.

Historically, line alarm systems use an electrical sense line or "sense loop" to detect the presence of an item of merchandise attached to a security device by means of a sensor (e.g. limit, proximity, etc.) switch disposed between the security device and the item of merchandise. The sense loop produces a binary ON/OFF alarm signal. A problem with conventional sense loop methodology is that a separate electrical circuit is routed in parallel from the alarm module to each sensor switch. Line alarm systems using the parallel routing method are more accurately described as "octopus" systems than "line alarm" systems since the sense loop cabling for each Display Position runs from the security device back to the central alarm module. A detriment of the parallel routing method is that the additional cabling required can utilize all of the available space under the display counter with only a few Display Positions installed. Alternatively, a single electrical circuit may be routed in series from the alarm module to all of the sensor switches. A detriment of the series routing method is that when the security device at one Display Position is disarmed (turned off), the security device at each of the other Display Positions is also disarmed. Both the parallel routing method and the series routing method lead to an undesirable condition if a retailer chooses to shut off the entire line alarm system, for example when one or more Display Positions are repeatedly false alarming, when maintenance is being performed, or when the retailer removes an item of merchandise from a Display Position to allow a customer to examine and operate the merchandise without the burden of the sensor cable (tether). When an entire line alarm system is turned off, it is oftentimes accidentally, or even intentionally, not turned back on.

BRIEF SUMMARY OF THE INVENTION

Embodiments of the present invention are directed to line alarm systems and methods for displaying merchandise. In one embodiment, the system includes a plurality of security devices, each of the security devices corresponding to a respective display position for an item of merchandise. The system may also include an alarm unit electrically connected to a plurality of nodes, wherein each of the nodes is electrically connected to at least one security device. The alarm unit is configured to monitor a change in a preselected characteristic of a circuit (e.g., a total resistance) defined by the electrical connection between the security devices and the nodes and between the nodes and the alarm unit. The alarm unit is further configured to determine whether an item of merchandise has been added to or removed from a respective display position based on a change in the preselected characteristic.

In some embodiments, the alarm unit is configured to determine an initial tare value of the total resistance of the circuit and to detect changes in the initial tare value when an item of merchandise is added to or removed from a respective display position. In one embodiment, the alarm unit is electrically connected to the nodes with a common bus line, and the nodes are electrically connected to a security device with a respective sensor line. The alarm unit may be configured to activate an alarm in response to unauthorized removal of an item of merchandise. The system may further include a power supply electrically connected to each of the nodes with a respective power line. Each power line may include a transformer configured to provide power requirements for a corresponding item of merchandise. In some embodiments, the alarm unit is electrically connected in series to each of the nodes, and/or each of the nodes is electrically connected in series to each of the security devices.

In one embodiment, a method for monitoring a status of a plurality of merchandise display devices for displaying items of merchandise at respective display positions is provided. For example, the method includes monitoring for a change in a preselected characteristic of a circuit (e.g., a total resistance) defined by an electrical connection between the security devices and a plurality of nodes and between the nodes and an alarm unit. The method also includes determining whether an item of merchandise has been added to or removed from a respective display position based on a change in the preselected characteristic.

In one embodiment, the method further includes determining an initial tare value of the total resistance of the circuit and detecting changes in the initial tare value when an item of merchandise is added to or removed from a respective display position. In one aspect, detecting a positive change in the initial tare value is indicative of an item of merchandise being added to a display position. The method may include determining a new tare value of the total resistance of the circuit when a positive change in the initial tare value is detected. In another aspect, detecting a negative change in the initial tare value is indicative of an item of merchandise being removed from a display position. The method may include activating an alarm when a negative change in the initial tare value is detected. In one embodiment, the method includes discontinuing monitoring for a predetermined period of time in response to communication with a security key. The method may further include ignoring a change in the initial tare value during the predetermined period of time, and/or establishing a new tare value after the predetermined period of time.

DETAILED DESCRIPTION

Embodiments of the present invention will now be described more fully hereinafter with reference to the accompanying drawings, in which various embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime notation and multiple prime notations are used to indicate similar elements in alternative embodiments.

Embodiments of the present invention are directed to a line alarm system for display merchandise in which a plurality of Display Positions are linked together in a series arrangement and additional Display Positions may be added by "daisy chaining" another Display Position to the system. The line alarm system may be anchored by (i.e., initiated by or terminated with) an alarm unit operable for monitoring the status of a merchandise display security sensor mounted at each Display Position and for activating an alarm in the event that the security sensor indicates a breach (unsecured) condition.

Figure 1:
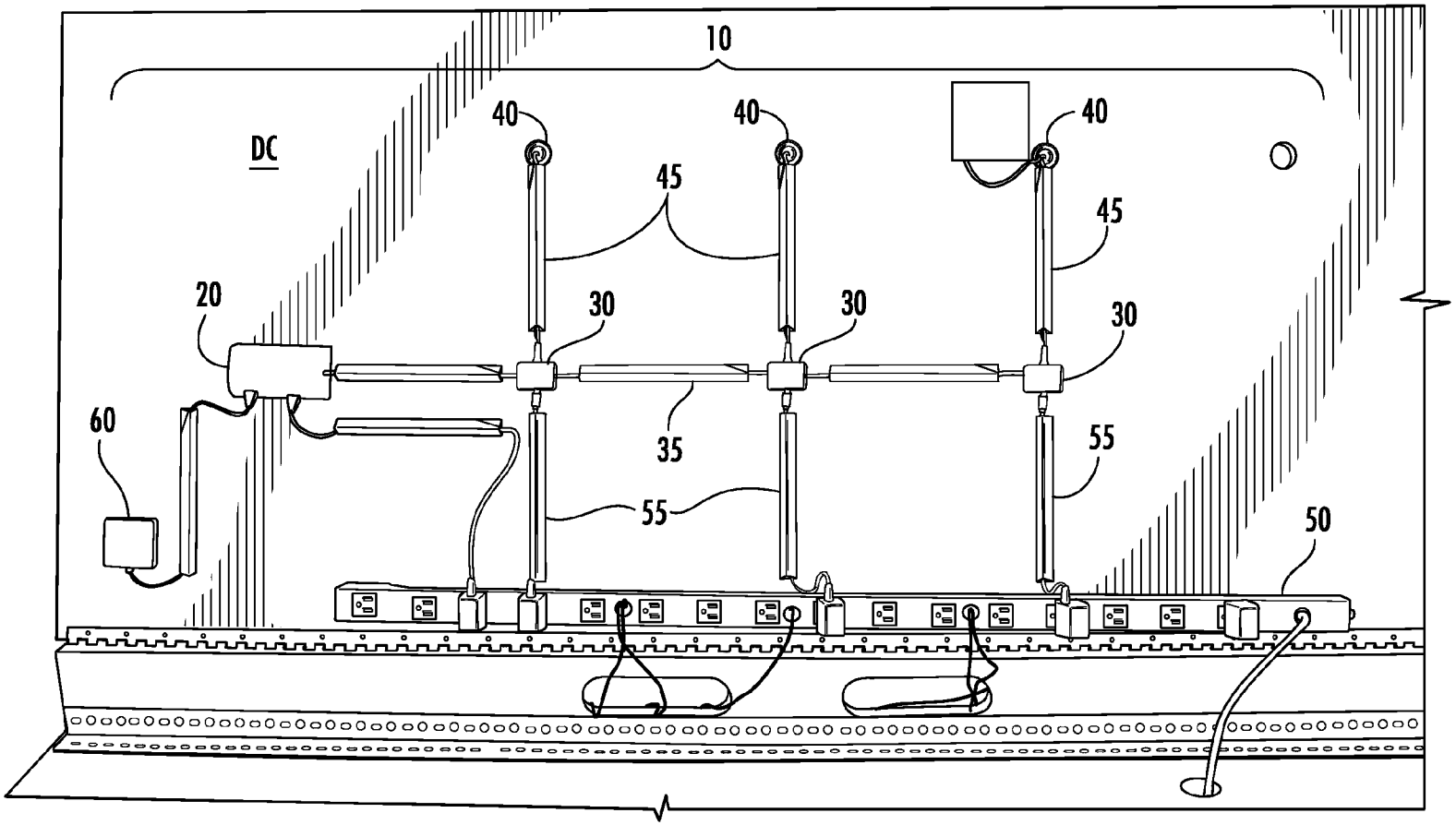
FIG. 1 illustrates a merchandise security line alarm system comprising three (3) Display Positions configured in accordance with embodiments of the invention. As will be described in greater detail hereinafter, additional Display Positions comprising the same or different security devices for displaying additional items of merchandise may be added to the line alarm system in a "daisy chain" manner.
Figure 2:
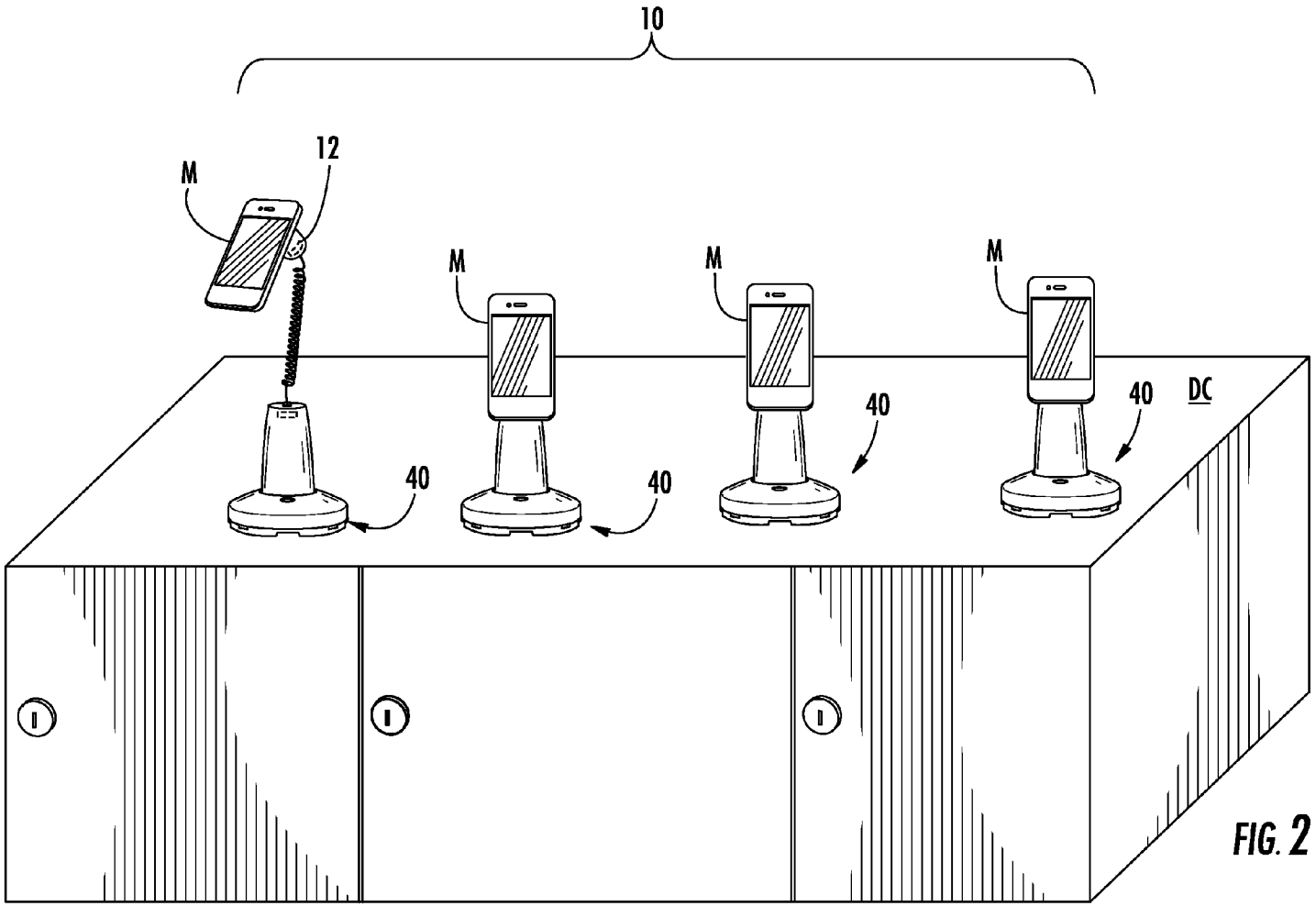
FIG. 2 shows a merchandise security line alarm system including a display counter with a plurality of items of merchandise displayed thereon according to one embodiment of the invention.

According to one embodiment, the present invention is a line alarm system 10 for monitoring a plurality of security devices 12 attached to an item or merchandise "M" and positioned on a Display Counter "DC" at a corresponding plurality of Display Positions 40 (see FIG. 2). As shown in FIG. 1, the line alarm system according to one embodiment, indicated generally by reference character 10, comprises an Alarm Unit 20 electrically connected in series to a plurality of Nodes 30 by a common Bus Line 35. In turn, each Node 30 is electrically connected in series to a security device 12 at a corresponding Display Position 40 via a corresponding Sensor Line 45. Likewise, each Node 30 is electrically connected in series to a common power supply (i.e. Power Strip) 50 via a corresponding Power Line 55. If desired, the Alarm Unit may also be electrically connected in series to an optional auxiliary component, such as a Digital Media System 60 for providing advertising content to, and/or for obtaining customer interaction data from, one or more of the Display Positions 40. As shown in FIG. 1, the alarm unit may anchor an electrical circuit defined by the connections between the nodes and the security devices and the connections between the nodes and the alarm unit. As shown, the electrical circuit may terminate at the alarm unit.

The line alarm system 10 overcomes the disadvantages and deficiencies of prior art line alarm systems by utilizing a novel and unique sensing methodology. Instead of detecting a simple "open" in the circuit of the system, the sensing methodology of the present invention monitors a change in a preselected characteristic of the circuit. In an exemplary embodiment, monitoring electronics disposed within the Alarm Unit 20 monitors a change in the overall (total) resistance of the circuit. However, the monitoring electronics of the Alarm Unit 20 may be configured to monitor a change in any characteristic of the circuit, for example a change in the light intensity of an optical circuit of the system. When a Display Position is connected or disconnected, the total resistance of the circuit of the system changes. Based on the direction of the change in the resistance of the circuit, the monitoring electronics can determine whether an item of merchandise was added at a Display Position, or was removed from a Display Position.

In one embodiment, the monitoring electronics of the Alarm Unit 20 determines an initial value of the total resistance as a "tare" value of the system to be monitored. The monitoring electronics then monitors the total resistance of the system for a change in that initial value. If an item of merchandise is added to an existing Display Position (or a new Display Position is created), the total resistance of the system will change in known manner, for example in a positive direction. Accordingly if the monitoring electronics detects a change in the total resistance in a positive direction, the Alarm Unit 20 merely reestablishes the initial value of the total resistance of the system to a new "tare" value. However, if the monitoring electronics detects a change in the total resistance in a negative direction, the Alarm Unit 20 determines that an item of merchandise has been removed from the line alarm system and activates an alarm indicating a potential theft of the item of merchandise.

A particular advantage of a line alarm system 10 according to the invention is that an additional Display Position 40 for another item of merchandise can be incorporated into the system "on the fly" without requiring the system to be turned off. Since the monitoring electronics of the Alarm Unit 20 remain enabled (turned on), the likelihood that store personnel will turn the system off and then accidently or intentionally fail to reactivate (turn on) the system is reduced. In the event that store personnel need to remove a security device from the system 10, or to perform maintenance on the security device or the node at a specific Display Position 40, a security key can be used to cause the monitoring electronics to enter a "sleep" or "maintenance mode." The monitoring electronics of the Alarm Unit 20 would then discontinue monitoring the total resistance of the system for a limited time (e.g. a maintenance window), or alternatively, would ignore the next negative change in the total resistance of the system and not activate the alarm. Once the predetermined time period elapsed, or the next negative change in the total resistance occurred, the monitoring electronics of the Alarm Unit 20 would reestablish a new "tare" value at the current value of the total resistance of the system and the system would rearmed automatically. In the event that an item of merchandise had been removed to allow a customer to examine and operate the merchandise free of the sensor cable (tether), the monitoring electronics will detect a positive change in the total resistance of the system when the item of merchandise is reattached to the security device and will automatically tare again to the new value of the total resistance of the line alarm system.

Another advantage of a line alarm system 10 according to embodiments of the invention is that different types of security devices can be used at different Display Positions 40 of the line alarm system for protecting various items of merchandise having different operating power (i.e. voltage and/or current) requirements without the need to utilize complex and highly sophisticated monitoring electronics since the monitoring electronics monitors only the total resistance of the line alarm system instead of having to monitor the sense loops of several different security devices operating with different electrical characteristics.

Yet another advantage of a line alarm system 10 according to embodiments of the invention is that the routing and management of the Sensor Lines 45 and Power Lines 55 for the security devices at the various Display Positions 40 is greatly simplified and significantly more aesthetic than prior art line alarm systems for displaying and protecting a like number of items of merchandise.

Yet another advantage of a line alarm system 10 according to embodiments of the invention is that the Power Line 55 for the security device at each of the various Display Positions 40 can comprise a customized transformer 56 configured to provide the appropriate power requirements (i.e. voltage and/or current) for operating the corresponding item of merchandise. Alternatively, the Node 30 at each of the various Display Positions 40 can comprise a customized voltage regulator circuit configured to provide the appropriate operating power to the corresponding item of merchandise.

Many modifications and other embodiments of the invention will be readily apparent to one skilled in the art having the benefit of the teachings presented in the foregoing descriptions and the associated drawings. Therefore, it is understood and appreciated that the invention is not to be limited to the specific embodiments disclosed herein, and that modifications to the disclosed embodiments and other undisclosed embodiments are intended to be included within the scope of the appended claims.

That which is claimed is:

1. A merchandise security system comprising:

a plurality of security devices, each of the security devices corresponding to a respective display position for an item of merchandise;

an alarm unit electrically connected to a plurality of nodes, each of the nodes electrically connected to at least one security device, wherein the alarm unit is configured to monitor a change in a preselected characteristic of a circuit defined by the electrical connection between the security devices and the nodes and between the nodes and the alarm unit, and wherein the alarm unit is configured to determine whether an item of merchandise has been added to a respective display position based on a change in the preselected characteristic of the circuit, and wherein the alarm unit is further configured to determine whether an item of merchandise has been removed from a respective display position based on a change in the preselected characteristic of the circuit.

2. The merchandise security system of claim 1, wherein the preselected characteristic is a total resistance of the circuit.

3. The merchandise security system of claim 2, wherein the alarm unit is configured to determine an initial tare value of the total resistance of the circuit and to detect changes in the initial tare value when an item of merchandise is added to or removed from a respective display position.

4. The merchandise security system of claim 1, wherein the alarm unit is electrically connected to the nodes with a common bus line.

5. The merchandise security system of claim 1, wherein the nodes are electrically connected to a security device with a respective sensor line.

6. The merchandise security system of claim 1, wherein the alarm unit is configured to activate an alarm in response to unauthorized removal of an item of merchandise.

7. The merchandise security system of claim 1, further comprising a power supply electrically connected to each of the nodes with a respective power line.

8. The merchandise security system of claim 7, wherein each power line comprises a transformer configured to provide power requirements for a corresponding item of merchandise.

9. The merchandise security system of claim 1, wherein the alarm unit is electrically connected in series to each of the nodes.

10. The merchandise security system of claim 1, wherein each of the nodes is electrically connected in series to each of the security devices.

11. A method for monitoring a status of a plurality of merchandise display devices for displaying items of merchandise at respective display positions, the method comprising:

monitoring for a change in a preselected characteristic of a circuit defined by an electrical connection between the plurality of merchandise display security devices and a plurality of nodes and between the nodes and an alarm unit; and determining whether an item of merchandise has been added to a respective display position based on a change in the preselected characteristic of the circuit; and determining whether an item of merchandise has been removed from a respective display position based on a change in the preselected characteristic of the circuit.

12. The method of claim 11, wherein the monitoring comprises monitoring a change in a total resistance of the circuit.

13. The method of claim 12, further comprising:

determining an initial tare value of the total resistance of the circuit; and detecting changes in the initial tare value when an item of merchandise is added to or removed from a respective display position.

14. The method of claim 13, wherein detecting a positive change in the initial tare value is indicative of an item of merchandise being added to a display position.

15. The method of claim 14, further comprising determining a new tare value of the total resistance of the circuit when a positive change in the initial tare value is detected.

16. The method of claim 13, wherein detecting a negative change in the initial tare value is indicative of an item of merchandise being removed from a display position.

17. The method of claim 16, further comprising activating an alarm when a negative change in the initial tare value is detected.

18. The method of claim 13, further comprising discontinuing monitoring for a predetermined period of time in response to interaction with a security key.

19. The method of claim 18, further comprising ignoring a change in the initial tare value during the predetermined period of time.

20. The method of claim 18, further comprising establishing a new tare value after the predetermined period of time.

* * * * *